United States Patent [19]

Herbert et al.

[11] Patent Number: 5,049,243

[45] Date of Patent: Sep. 17, 1991

[54] ELECTROFORMING PROCESS FOR MULTI-LAYER ENDLESS METAL BELT ASSEMBLY

[75] Inventors: William G. Herbert, Williamson; Kenneth N. Traub, Rochester; John F. Murphy, Webster, all of N.Y.

[73] Assignee: Xerox Corporation, Stamford, Conn.

[21] Appl. No.: 632,998

[22] Filed: Dec. 24, 1990

[51] Int. Cl.[5] ..... C25D 1/02

[52] U.S. Cl. ..... 204/9

[58] Field of Search ..... 204/3, 4, 9

[56] References Cited

U.S. PATENT DOCUMENTS

| | | | |
|---|---|---|---|
| 3,604,283 | 9/1971 | Van Doorne | 474/8 |
| 3,799,859 | 3/1974 | Wallin | 204/216 |
| 3,844,906 | 11/1974 | Bailey et al. | 204/9 |
| 3,959,109 | 5/1976 | Hambling et al. | 204/212 |
| 3,970,527 | 7/1976 | Brown | 204/9 |
| 4,067,782 | 1/1978 | Bailey et al. | 204/25 |
| 4,501,646 | 2/1985 | Herbert | 204/4 |
| 4,530,739 | 7/1985 | Hanak et al. | 204/4 |
| 4,579,549 | 4/1986 | Okawa | 474/242 |
| 4,650,442 | 3/1987 | Parsons | 474/29 |
| 4,661,089 | 4/1987 | Cuypers | 474/242 |
| 4,664,758 | 5/1987 | Grey | 204/3 |
| 4,787,961 | 11/1988 | Rush | 204/9 |
| 4,902,386 | 2/1990 | Herbert et al. | 204/9 |

OTHER PUBLICATIONS

Keeton, C. R., *Metals Handbook*, 9th Edition, "Ring Rolling", pp. 108–127.

*Primary Examiner*—T. M. Tufariello

*Attorney, Agent, or Firm*—Oliff & Berridge

[57] ABSTRACT

An electroforming process for forming a multilayer endless metal belt includes submerging a mandrel in an electroforming bath, electroforming a first layer on the mandrel, forming a passive coating on the outer surface of the first layer, and depositing at least one additional layer on the oxide coating. By this process, a multilayer metal belt is formed with non-adhesive layers. The belt may then be cut to the desired width, and is particularly useful as a driving member for a continuously-variable transmission.

23 Claims, No Drawings

ELECTROFORMING PROCESS FOR MULTI-LAYER ENDLESS METAL BELT ASSEMBLY

BACKGROUND OF THE INVENTION

This invention relates in general to electroformed belts, and in particular, to a process for electroforming metal belts.

Electroforming has been known for many years as a method for producing metal objects. In the electroforming process, an electric current is passed through an electrolyte solution in which tare immersed an anode and a cathode. A metal in the electrolyte solution is deposited onto either the anode or the cathode, thus forming an object.

U.S. Pat. No. 3,844,906 to Bailey et al discloses a process for maintaining a continuous and stable aqueous nickel sulfamate electroforming solution adapted to form a relatively thin, ductile, seamless nickel belt by electrolytically depositing nickel from the solution onto a support mandrel and thereafter recovering the nickel belt by cooling the nickel coated mandrel, and effecting a parting of the nickel belt from the mandrel due to different respective coefficients of thermal expansion comprising: establishing an electroforming zone comprising a nickel anode and a cathode comprising a support mandrel, an anode and a cathode being separated by a nickel sulfamate solution maintained at a temperature of about 140° to 160° F. and having a current density therein ranging from about 200 to about 500 amps/ft$^2$; imparting sufficient agitation to this solution to continuously expose the cathode to fresh solution; maintaining the solution within the zone at a stable equilibrium composition comprising nickel, halide and boric acid; electrolytically removing metallic and organic impurities from the solution upon removal from the electroforming zone; continuously charging to the solution about 1.0 to $2.0\times10^{-4}$ moles of a stress reducing agent per mole of nickel electrolytically deposited from the solution; passing the solution through a filtering zone to remove any solid impurities therefrom; cooling the solution sufficiently to maintain the temperature within the electroforming zone upon recycle thereto to about 140° to 160° F. at the current density in the electroforming zone; and recycling the solution to the electroforming zone.

U.S. Pat. No. 4,501,646 to Herbert discloses an electroforming process for forming hollow articles having a small cross-sectional area. In this patent, the electroforming process employs a cathode for the core mandrel having an electrically conductive, adhesive outer surface, an anode, and an electrolyte bath comprising a salt solution of the metals used for the electrodes. This process utilizes the differences in coefficient of expansion between the mandrel and the electroformed metal to remove the object. Thus, any suitable metal capable of being deposited by electroforming and having a coefficient of expansion between $6\times10^{-6}$ in /in./° F. and about $10\times10^{-6}$ in./in./° F. may be used in the process. The disclosed process is used for forming a belt having a thickness of at least about 30Å and stress-strain hysteresis of at least about 0.00015 in/in, and wherein a stress of between about 40,000 psi and about 80,000 psi is imparted to the cooled coating to permanently deform the coating and to render the length of the inner perimeter of the coating incapable of contracting to less than 0.04% greater than the length of the outer perimeter of the core mandrel after cooling.

U.S. Pat. No. 4,664,758 to Grey discloses an electroforming process with an additional step for facilitating the removal process. An electroforming mandrel is provided to which is initially applied, prior to electroforming, a uniform coating of an electrically conductive substrate or metal alloy. The metal or metal alloy has a melting point and a surface tension less than the melting point and surface tension of the mandrel core. The coated mandrel core is immersed in an electroforming bath, and an electroformed metal layer is deposited on the coating, the electroformed metal layer having a melting point greater than the metal or metal alloy. The electroformed metal layer is removed from the mandrel core, thus permitting the mandrel to be reused. This method provides precise control of the electroformed coatings, by compensating for surface defects in the mandrel with this initial coating. Other methods described in U.S. Pat. No. 4,664,758 employ wax or an oxide film as parting aid on the surface of a metal die.

U.S. Pat. No. 4,787,961 to Rush discloses the use of an electroforming process for preparing a multilayered metal belt. A tensile band set is formed from a plurality of separate looped endless bands in a nested and superimposed relation. The patent states that the bands are free to move relative to each other even though the spacing between adjacent bands is relatively small. These bands are formed in an apparatus comprising two rigid metallic anode plates. The metallic surface of the cylindrical mandrel is a cathode. By rotating the mandrel and at the same time interconnecting the cathode and anodes to the electrical power supply, material in the electrolyte bath is plated onto the surface to form a continuous or endless annular band.

During the above process, the belt is regularly removed from the electrolyte bath in order to coat it with a copper coating solution which keeps the belts from adhering to one another. Otherwise one very thick belt would be formed, instead of the several thin belts which are required, and it is the multiple layers of thin belts that are most advantageous for the operation of the continuously variable transmission. However, this removal step necessitates additional handling of the material and increases the number of steps and the expense of achieving the final product.

Thus, while the prior art has disclosed the use of the electroforming process for the manufacture of endless metal belts, it has failed to disclose a simple, inexpensive method for providing a multilayer endless metal belt which has the uniform small gaps, the exacting tolerances and the necessary low adhesion between layers required for the belts to slip easily over each other.

Endless metal belts have been taught in the prior art for many purposes, including use with continuously variable transmissions.

U.S. Pat. No. 3,604,283 to Van Doorne discloses a continuously-variable transmission. The driving mechanism comprises a driving pulley with a V-shaped circumferential groove, a driven pulley with a V-shaped circumferential groove, and a flexible endless member having chamfered (beveled) flanks interconnecting and spanning the pulleys. The diameters of the pulleys automatically and steplessly can be varied with regard to each other in such a way that an infinite number of different transmission ratios can be obtained. The described driving member is a flexible endless member consisting of one or more layers of steel belts.

U.S. Pat. No. 4,661,089 to Cuypers discloses an endless metal belt for use with a continuously variable transmission which can be subjected to greater strains and which has considerably longer service life. This patent describes an endless metal belt wherein the tensile stresses during operation are decreased by compressive stresses at the belt's edge zone. When such stresses are reduced, in particular by the tensile stresses caused by the bending stress, the strain on the belts is reduced and the likelihood of belt breakage caused by hairline cracks occurring from the edges is decreased.

In view of the great demand and many uses for endless metal belts, it is very desirable to find a less costly method of manufacturing these belts, and in such a manner that they will have the exacting tolerances needed.

SUMMARY OF THE INVENTION

It is an object of the invention to provide an improved electroforming process wherein multiple belts of an endless metal belt assembly are superimposed and do not adhere to one another.

In accordance with the present invention, an electroforming process is provided wherein multiple belts of a superimposed endless metal belt assembly are formed in such a manner that the belts do not adhere to one another. This may be accomplished by forming a passive coating between each adjacent pair of superimposed belts.

The electroformed belt may be exposed to air to permit the passive coating in the form of an oxide layer to form thereon, or the bath chemistry or other operating parameters of the electroforming bath may be adjusted to produce the aforementioned passive coating. This may be accomplished without removal of the mandrel and the electroformed belt from the bath.

DETAILED DESCRIPTION OF PREFERRED EMBODIMENTS

This invention provides an electroforming process for forming a multilayer endless metal belt assembly which has a passive coating between adjacent belts which prevents adhesion between those belts. The passive coating may be formed between the belts by several methods, some of which do not require removal of the belt from the electrolyte solution. For example, the electroformed belt may be exposed to air, thereby causing the exposed surface to oxidize. In another embodiment, the chemistry of the electrolyte bath may be adjusted or the operating parameters may be manipulated in order to produce a passive coating on an exposed electroformed metal belt. The next belt is then electroformed; the process is repeated as desired, and the product need not be removed from the bath during the process. After the endless metal belt assembly is formed, it is removed from the electroforming apparatus and, if necessary, cut to the desired width.

The present method may employ an electroforming process similar to that described in U.S. Pat. No. 3,844,906, which is hereby incorporated by reference. While in the process described herein the metal ions deposit on the cathode, it is also possible for them to deposit on the anode, and this invention includes both arrangements.

The electroforming process takes place within an electroforming zone comprised of an anode selected from a metal and alloys thereof; a cathode which is the core mandrel; and an electroforming bath comprising a salt solution of the metal or alloys thereof which constitutes the anode, and in which bath both the anode and cathode are immersed.

Any suitable metal capable of being deposited by electroforming and having a coefficient of expansion between $6\times10^{-6}$ in./in./° F. and about $10\times10^{-6}$ in /in./° F. may be used in the process of this invention. Preferably the electroformed metal has a ductility of at least about 0.5% elongation. Typical metals that may be electroformed include nickel, copper, cobalt, iron, silver, lead, zinc, aluminum, tin, rubidium, rhenium, palladium, and the like, and alloys thereof, such as brass and bronze. All of the aforementioned metals are amenable to forming an oxide coating, except for palladium.

The core mandrel is preferably solid and of large mass to reduce cooling of the mandrel while the deposited coating is cooled. In such an embodiment, the mandrel should have high heat capacity, preferably in the range from about 3 to about 4 times the specific heat of the electroformed article material. This determines the relative amount of heat energy contained in the electroformed article compared to that in the core mandrel.

Further, the core mandrel in such an embodiment should exhibit low thermal conductivity to maximize the difference in temperature between the electroformed article and the core mandrel during rapid cooling of the electroformed article to prevent any significant cooling and contraction of the core mandrel. It has been found that the success of a continuous electroforming process is, in large part, dependent upon the ease of parting of the electroformed belt from the mandrel. Thus, it has been found that a diametric parting gap, i.e., the gap formed by the difference between the average inside electroformed belt diameter and the average mandrel diameter at the parting temperature, must be at least about 0.000254 mm for reliable and rapid separation of the belt from the mandrel.

The belt must be bigger than the mandrel (assuming that the mandrel is not tapered) if one is going to remove the belt from the outside of the mandrel. This can be facilitated by using a mandrel which is chiefly fabricated of a material which has a linear coefficient of thermal expansion which is larger or smaller than the linear coefficient of thermal expansion of the belt. An aluminum mandrel meets these criteria with respect to a nickel belt, for example. In cross section (from inside out), such a mandrel may be 1 inch of aluminum, 0.001 inch of nickel, and 0.001 inch of chromium. Aluminum has a linear coefficient of thermal expansion of about $13\times10^{-6}$ in/in/° F. and nickel has a linear coefficient of thermal expansion of about $8\times10^{-6}$ in/in/° F. A mandrel which has a 20.69000 inch outside diameter at room temperature (70° F.) expands to 20.70883 at 140° F. If a nickel belt is deposited on this mandrel at 140° F. (typical operating temperature of the electrolyte) and the nickel belt is then cooled to 40° F., the mandrel will have an outside diameter of 20.68190 and the nickel belt will have an inside diameter of 20.69226 (assuming that the internal stress is zero). The resulting parting gap will be 0.01036 inches. To separate a belt made on a mandrel with a linear coefficient of thermal expansion which is less than that of the belt, the belt and the mandrel are heated to obtain a parting gap.

This relationship can be expressed in the following manner:

$$PARTING\ GAP = T(\alpha_M - \alpha_d)D$$

wherein T is the difference between the parting temperature and the deposition temperature, $\alpha_M$ is the linear coefficient of thermal expansion of the mandrel, $\alpha_d$ is the linear coefficient of thermal expansion of the deposit, and D is the outside diameter of the mandrel at the deposition temperature.

The electroforming process of this invention may be conducted in any suitable electroforming device. For example, a solid cylindrically shaped mandrel may be suspended vertically in an electroforming tank. The mandrel is constructed of electrically conductive material that is compatible with the metal plating solution, (e.g., stainless steel). The top edge of the mandrel may be masked off with a suitable, non-conductive material, such as wax, to prevent deposition. The mandrel may be of any suitable cross-section for the formation of an endless metal belt.

The electroforming tank is filled with the electroforming bath and the temperature of the bath is maintained at the desired temperature. The electroforming tank can contain an annular shaped anode basket which surrounds the mandrel and which is filled with metal chips. The anode basket is disposed in axial alignment with the mandrel. The mandrel is connected to a rotatable drive shaft driven by a motor. The drive shaft and motor are supported by suitable support members. Either the mandrel or the support for the electroforming tank may be vertically and horizontally movable to allow the mandrel to be moved into and out of the electroforming solution.

Electroforming current can be supplied to the tank from a suitable DC source. The positive end of the DC source can be connected to the anode basket and the negative end of the DC source connected to the drive shaft which supports and drives the mandrel. The electroforming current passes from the DC source connected to the anode basket, to the plating solution, the mandrel, the drive shaft, and back to the DC source.

In operation, the mandrel is lowered into the electroforming tank, and is preferably continuously rotated. As the mandrel rotates, a layer of electroformed metal is deposited on its outer surface. The electroformed belt is preferably thin, in order that many belts may be able to carry the load required, with each belt independently movable while superimposed in the "nest" of belts comprising the endless metal belt assembly.

The thickness of each belt depends on the size of the continuously variable transmission and the material forming the belt. Each belt is preferably between 0.006 and 0.6 mm thick, more preferably 0.012 to 0.13 mm thick, and most preferably 0.043 to 0.046 mm thick.

When multiple belts form an assembly of belts, each belt within the assembly is separated from the adjacent belt or belts by a gap which contains a lubricant. An advantage of the electroforming process is that it enables very thin belts to be formed in a manner that controls the gap size optimally. The optimal thickness of the belt material is identified by determining the belt thickness associated with the lowest total stress (bending stress plus direct stress) on the belt in a given dual pulley system. The total stress is equal to the sum of the bending stress plus the direct stress. Bending stress is equal to $EC/\rho$, wherein E is the elasticity of the belt material, C is one half the belt thickness, and p is the radius of curvature of the smallest pulley. Direct stress is equal to $F_1/A$, wherein $F_1$ is the tight side force between the pulleys and A is the cross-sectional area of the belt. The total stress is calculated for a series of belts of different thicknesses, and the belts are formed with the thickness which has the lowest total stress value.

The optimal gap size is the minimum gap necessary to provide adequate lubrication, since a smaller gap permits the lubricant to carry more torque than does a larger gap. This size can readily be determined by those of skill in the art. The optimal lubricant is identified by determining the lubricant with the highest torque-carrying ability within its optimal gap. The torque carrying ability of a given lubricant is equal to $$T=4\mu\pi^2Nr^3l/M_r$$

Wherein $\mu$ is the absolute viscosity of the lubricant, N is the rotational velocity of the smallest pulley, r is the radius of the smallest pulley, l is the width of the belt and $M_r$ is the radial clearance (gap) between adjacent belts. The torque carrying ability is calculated for a series of different lubricants and a lubricant is selected which provides the highest value. The methods of determining optimal belt thickness and lubricant are disclosed in detail in copending application Ser. No. 07/632,519, filed simultaneously herewith and entitled "Endless Metal Belt Assembly With Controlled Parameters," which is hereby incorporated by reference.

Where the belts are constructed in an assembly, lubrication is important to reduce friction between adjacent belts. Electroformed belts may be constructed with surfaces designed to trap and circulate lubricant with protuberances, indentations, and pits formed by adjusting parameters of the electroforming bath such as the mandrel surface roughness, metal ion concentration, rate of current application, current density and operating temperature of the electrolyte. The protuberances thus formed, for example, may be up to about 95% of the gap size. Electroformed belts with such surfaces are disclosed in detail in copending application Ser. No. 07/633,604 filed simultaneously herewith and entitled "Endless Metal Belt Assembly with Minimized Contact Friction," which is hereby incorporated by reference.

The belts may be further improved by electroforming the belts so that adjacent and opposing belt surfaces are constructed of materials of different hardness, such as nickel and chromium, as disclosed in detail in copending application Ser. No. 07/633,025 filed simultaneously herewith and entitled "Endless Metal Belt Assembly with Hardened Belt Surfaces," which is hereby incorporated by reference.

When the layer of deposited metal forming the belt has reached the desired thickness, the belt is then treated in accordance with one of the methods described herein for the formation of a passive coating on the electroformed belt. After the passive coating is formed, the sequence of electroforming a belt followed by formation of a passive coating is repeated until the desired number of belts is formed. The passive coating on each belt provides a non-adhesive interlayer which results in the endless metal belts being formed in a "nest" with the tight tolerances required for use in a continuously variable transmission. Depending on the metal forming the belt, each oxide layer is preferably 5Å to 1500Å, more preferably 100Å to 500Å, thick.

Each successive belt is electroformed to a specific thickness and internal stress. By controlling the internal stress in each successive belt, the diameter of the belts can be increased in such a manner that a controlled gap is formed between adjacent layers. This is accomplished by adjusting those parameters which produce a compressive stress, such as electroforming bath temperature, current density, agitation and stress reducer concentration, as disclosed in detail in copending application Ser. No. 07/632,518, filed simultaneously herewith and entitled "Electroforming Process for Endless Metal Belt Assembly with Belts that are Increasingly Compressively Stressed," which is hereby incorporated by reference. The number of superimposed belts which may be formed in this controlled manner may range from 2 to 60 or more.

When the electroforming of the last belt is complete, the mandrel is removed from the electroplating tank and immersed in a cold water bath. The temperature of the cold water bath is preferably between about 80° F. and about 33° F. A large difference in temperature between the temperature of the cooling bath and the temperature of the coating and mandrel maximizes permanent deformation due to the stress-strain hysteresis effect. When the mandrel is immersed in the cold water bath, the deposited metal belts are cooled prior to any significant cooling and contracting of the solid mandrel to impart an internal stress of between about 40,000 psi and about 80,000 psi to the deposited metal. Since the metal is selected to have a stress-strain hysteresis of at least about 0.00015 in/in, it is permanently deformed, so that after the core mandrel is cooled and contracted, the deposited metal belt assembly may be removed from the mandrel. The multilayer belt assembly so formed does not adhere to the mandrel since the mandrel is formed from a passive material. Consequently, as the mandrel shrinks after permanent deformation of the deposited metal, the belt may be readily slipped off the mandrel.

The belts formed by the electroforming process of the invention may have their edges strengthened so that the ductility of their edge regions is greater than that of their center regions, for instance by annealing the edges, as disclosed in detail in copending application Ser. No. 07/633,027, filed simultaneously herewith and entitled "Endless Metal Belt with Strengthened Edges," which is hereby incorporated by reference.

The formation of a passive coating on the electroformed layer may be accomplished by any of several methods. First, for example, the electroformed belt may be exposed to air, to form an oxide layer on the exposed surface. To expose the belt surface, the belt may be completely removed from the electroforming solution, or only partially removed. In the event of complete removal, several embodiments may be employed. In one embodiment, the belt is removed, rinsed with 140°-180° F./million ohm or higher water, allowed to stand in air for 10-20 seconds, and then returned to the bath. See Example 1A.

In another embodiment, the belt is removed, rinsed with 150°-180° F. 5 ppm nickel solution, allowed to stand for 8-15 seconds in air, and then returned to the bath. See Example 1B.

EXAMPLES 1-A and 1-B

Major Electrolyte Constituents:

Nickel sulfamate - as $Ni^{+2}$, 10.0-11.5 oz/gal. (75-86.25 g/L)

Chloride - as $NiCl_2 \cdot 6H_2O$, 1.0-7 oz/gal. (7.5-52.5 g/L)

Boric Acid - 5.0-5.4 oz/gal. (37.5-40.5 g/L)

pH - 3.85-4.05 at 23° C.

Surface tension - at 136° F., 32-37 d/cm using sodium lauryl sulfate (about 0.00525 g/1)

Saccharin - 0-25 mg/L, as sodium benzosulfimide dihydrate

Impurities

Aluminum - 0-20 mg/L

Ammonia - 0-400 mg/L

Arsenic - 0-10 mg/L

Azodisulfonate - 0-50 mg/L

Cadmium - 0-10 mg/L

Calcium - 0-20 mg/L

Hexavalent chromium - 4 mg/L maximum

Copper - 0-25 mg/L

Iron - 0-250 mg/L

Lead - 0-8 mg/L

MBSA - (2-methyl benzene sulfonamide) - 0-20 mg/L

Nitrate - 0-10 mg/L

Organics - Depends on the type, however, all known types need to be minimized

Phosphates - 0-10 mg/L

Silicates - 0-10 mg/L

Sodium - 0-0.5 gm/L

Sulfate - 0-2.5 g/L

Zinc - 0-5 mg/L

Operating Parameters

Agitation Rate - 4-6 Linear ft/sec solution flow over the cathode surface

Cathode (Mandrel) - Current Density, 100-300 ASF (amps per square foot)

Ramp Rise - 0 to operating amps in 60 sec. ±5 sec.

Plating Temperature at Equilibrium - 130°-150° F.

Anode - electrolytic, depolarized, or carbonyl nickel

Anode to Cathode Ratio - 1:1 minimum

Mandrel Core - aluminum

After the desired thickness of nickel has been deposited for this layer, current is terminated and the composite (mandrel with belt/belts) is removed from the electrolyte. The composite is then rinsed with 165° F. 2 million Ohm deionized water until all electrolyte is removed (Example 1-A), or the composite is rinsed with 50° F 5ppm nickel sulfamate solution (Example 1-B). The composite is then left to stand in air for 10 seconds and 5 seconds, respectively, before returning it to the electrolyte. Upon return to the electrolyte, the next layer is deposited.

Alternatively, the metal belt may be rinsed with hot acetic acid and cold dilute 0.5% sulfuric acid solution, allowed to stand in air for 4-10 seconds, and then returned to the bath. If the belt is partially removed, the method employing the water-rinse described above is used, but the belt is only exposed to air for 2-8 seconds. Partial removal can accelerate the oxidation of the exposed portion of the belt. In another alternative embodiment, the belt may be rinsed with water, and then allowed to stand in a chamber containing only sulfur dioxide gas for 3-5 seconds. Such a process will form an oxide coating, but is less desirable because of the undesirable odor of the sulfur dioxide gas.

In an alternative embodiment, the passive layer can be formed by simply interrupting the current; this permits a thin passive layer to form in approximately 0.1 second. See Example 2.

EXAMPLE 2

Major Electrolyte Constituents:

Nichel sulfamate - as $Ni^{+2}$,10.0-11.5 oz/gal. (75-86.25 g/L)

Chloride - as $NiCl_2.6H_2O$, 1.0-1.5 oz/gal. (7.5-11.25 g/L)

Boric acid - 5.0-5.4 oz/gal. (37.5-40.5 g/L)

pH - 3.85-4.05 at 23° C.

Surface tension - at 136° F., 32–37 d/cm using sodium lauryl sulfate (about 0.00525 g/1)
Saccharin - 5–60 mg/L, as sodium benzosulfimide dihydrate
Impurities
Aluminum - 5–20 mg/L
Ammonia - 10–400 mg/L
Arsenic - 0–10 mg/L
Azodisulfonate - 10–70 mg/L
Cadmium - 0–10 mg/L
Calcium - 5–50 mg/L
Hexavalent chromium - 4 mg/L maximum
Copper - 2–50 mg/L
Iron - 10–250 mg/L
Lead - 0–8 mg/L
MBSA - (2-methyl benzene sulfonamide) - 5–40 mg/L
Nitrate - 0–10 mg/L
Organics - Depends on the type, however, all known types need to be minimized
Phosphates - 0–10 mg/L
Silicates - 2–20 mg/L
Sodium - 0.001–0.5 g/L
Sulfate - 0.05–2.5 g/L
Zinc - 0–5 mg/L
Operating Parameters
Agitation Rate - 4–6 Linear ft/sec solution flow over the cathode surface
Cathode (Mandrel) - Current density, 100–300 ASF (amps per square foot)
Ramp Rise - 0 to operating amps in 60 sec. ±5 sec.
Plating Temperature at Equilibrium - 130°–150° F.
Anode - sulfur depolarized nickel
Anode to cathode ratio - 1:1 minimum
Mandrel core - aluminum After the desired thickness of the first layer is obtained, the current is interrupted for at least 0.1 sec. After the interruption the current is reapplied. This procedure is repeated until the desired number of layers are obtained.

In another embodiment, the passive layer can be formed anodically, wherein the electroforming apparatus is subjected to a reverse current. This can be done by turning off the main electric power supply, and turning on a supplemental, separate power supply with lower amperage. This process quickly forms a thin oxide layer, the oxygen being derived directly from the bath in this embodiment. The potential is kept at a power level less than that which causes dissociation of the metal at the cathode. For nickel, this level is approximately 0.5V ½ cell voltage SHE (standard hydrogen electrode). See Example 3.

EXAMPLE 3

Major Electrolyte Constituents:
Nickel sulfamate - as $Ni^{+2}$, 10.0 oz/gal. (75 g/L)
Chloride - as $NiCl_2.6H_2O$, 1.5 oz/gal. (11.25 g/L)
Boric acid - 5.0–5.4 oz/gal. (37.5–40.5 g/L)
pH - 3.850–3.900 at 23° C.
Surface tension - at 136° F., 32–37 d/cm using sodium lauryl sulfate (about 0.00525 g/1)
Saccharin - 5–60 mg/L, as sodium benzosulfimide dihydrate
Impurities
Aluminum - 10 mg/L
Ammonia - 40 mg/L
Arsenic - 0 mg/L
Azodisulfonate - 10 mg/L
Cadmium - 0 mg/L
Calcium - 5 mg/L
Hexavalent chromium - 0 mg/L maximum
Copper - 0–50 mg/L
Iron - 25 mg/L
Lead - 0 mg/L
MBSA - (2-methyl benzene sulfonamide) - 5–40 mg/L
Nitrate - 0 mg/L
Organics - Depends on the type, however, all known types need to be minimized
Phosphates - 0 mg/L
Silicates - 2 mg/L
Sodium - 35 gm/L
Sulfate - 100 mg/L
Zinc - 0 mg/L
Operating Parameters
Agitation Rate - 4–6 Linear ft/sec solution flow over the cathode surface
Cathode (Mandrel) - Current density, 50–300 ASF (amps per square foot)
Ramp Rise - 0 to operating amps in 60 sec. ±5 sec.
Plating Temperature at Equilibrium - 138° F.
Anode - carbonyl nickel
Anode to Cathode Ratio - 10:1 minimum
Mandrel Core - 304 stainless steal After the desired thickness is obtained for the first layer, the current is quickly reduced without interruption until the composite is made to be slightly anodic. This may require the use of an additional power supply depending on the characteristics of the power supply used to electroform the bulk of the part. An oxide is formed by maintaining the current density at 0.075 ASF anodic for 60 seconds, then returned to the cathodic condition (50–300 ASF) used to electroform the bulk thickness. This procedure is repeated until the desired number of layers are obtained.

Finally, the passive layer can be formed cathodically, by plating out some of the impurities within the electrolyte bath. In order to do this, it is necessary to maintain the desired impurity level in the electrolyte bath. Such impurities may include iron, lead, copper, magnesium and others. When employing this embodiment, the cathodic potential is kept below the potential required to cause the metal ions forming the belt to deposit as the metal on the mandrel. Therefore, any metal which will oxidize faster than the metal of the belt will be suitable. For example, copper passivates faster and more easily than nickel, and therefore is suitable for this embodiment. See Examples 4-A and 4-B.

EXAMPLES 4-A AND 4-B

Major Electrolyte Constituents:
Nickel sulfamate - as $Ni^{+2}$, 10.0 oz/gal. (75 g/L)
Chloride - as $NiCl_2.6H_2O$, 1.5 oz/gal. (11.25 g/L)
Boric acid - 5.0–5.4 oz/gal. (37.5–40.5 g/L)
pH - 3.850–3.900 at 23° C.
Surface tension - at 136° F., 32–37 d/cm using sodium lauryl sulfate (about 0.00525 g/1)
Saccharin - 0–60 mg/L, as sodium benzosulfimide dihydrate
Impurities
Aluminum - 10 mg/L
Ammonia - 40 mg/L
Arsenic - 0 mg/L
Azodisulfonate - 10 mg/L
Cadmium - 0 mg/L
Calcium - 5 mg/L Hexavalent chromium - 0 mg/L maximum
Copper - 25–50 mg/L
Iron - 25 mg/L
Lead - 0 mg/L
MBSA - (2-methyl benzene sulfonamide) - 0–40 mg/L
Nitrate - 0 mg/L
Organics - Depends on the type, however, all known types need to be minimized
Phosphates - 0 mg/L
Silicates - 2 mg/L
Sodium - 35 g/L
Sulfate - 100–2500 mg/L
Zinc - 0 mg/L
Operating Parameters
Agitation Rate - 4–6 Linear ft/sec solution flow over the cathode surface
Cathode (Mandrel) - Current density, 50–300 ASF (amps
per square foot)
Ramp Rise - 0 to operating amps in 60 sec. ±5 sec.
Plating Temperature at Equilibrium - 142° F.
Anode - carbonyl nickel
Anode to Cathode Ratio - 5:1 minimum
Mandrel Core - aluminum After the first layer is deposited, in embodiment 4A, the current is reduced to a level that will allow copper to deposit but will not allow nickel to deposit (half cell potential of less than 0.5 volts versus a hydrogen electrode) for 15 seconds or in embodiment 4B the current is terminated (immersion deposit of copper) for 60 sec. The copper is then oxidized under the conditions of either Example 1–A or Example 1–B with 5ppm pH 6–8 copper solution instead of the 5ppm nickel solution.

An oxide can also be achieved per example 3.

The copper concentration in the electrolyte must be kept at or above 25 mg/L by adding copper ions to the bath as needed. If the copper concentration gets below 25 mg/L, more time is required to achieve the desired effect. At 10 mg/L, for example, it took 180 seconds to achieve the immersion deposit.

Note that interrupted current, as described in Example 2, will not work with the electrolyte/conditions described above in Example 4.

After removal from the mandrel, the belt is then rinsed in order to preserve the electrolyte, and air dried if being cut by machining or laser. In the event the belt is cut by electro-discharge machining, the belt is cut immediately after rinsing, without drying.

Other modifications of the present invention may occur to those skilled in the art subsequent to a review of the present application, and these modifications, including equivalents thereof, are intended to be included within the scope of the present invention.

What is claimed is:

1. An electroforming process, comprising:
submerging a mandrel in an electroforming bath;
electroforming a first belt on said mandrel;
forming a passive coating on the outer surface of said first belt;
electroforming at least one additional belt on said first belt;
wherein said mandrel remains submerged in the electroforming bath during the entire electroforming process.

2. The process of claim 1, wherein at least three electroformed belts are formed, and wherein a passive coating is formed between each successive belt.

3. The process according to claim 1, wherein the electroformed belt is comprised of a metal selected from the group consisting of Ni, Fe, Co, Au, Ag, Pb, Zn, Al, Sn, Ru, Rh and Pd.

4. The process according to claim 1, wherein the step of forming the passive coating includes adjusting the electroforming bath composition to enable formation of a passive coating and maintaining the bath under such conditions that a passive coating forms.

5. The process according to claim 1, wherein the step of forming a passive coating on the outer surface of the belt comprises the step of exposing the belt to air.

6. The process according to claim 1, wherein the step of forming a passive coating on the outer surface of the belt comprises interrupting the electric current being applied to the electroforming bath.

7. The process according to claim 6, wherein the current is interrupted for at least 0.1 to 5 seconds.

8. The process according to claim 1, wherein the step of forming a passive coating on the outer surface of the belt comprises the step of subjecting the electroforming bath to reverse current.

9. The process according to claim 1, wherein the step of forming a passive coating on the outer surface of the belt comprises the step of controlling the current to deposit impurities in the electroforming bath on the belt.

10. An electroforming process comprising:
submerging a mandrel in an electroforming bath;
electroforming a first belt on said mandrel;
forming a coating comprised of an oxide of the electroformed metal on the outer surface of said first belt;
electroforming at least one additional layer on said first belt.

11. The process according to claim 10, wherein at least three electroformed belts are formed, and wherein a coating comprised of an oxide of the electroformed metal is formed between each successive belt.

12. The process according to claim 10, wherein the electroformed belt is comprised of a metal selected from the group consisting of Ni, Fe, Co, Au, Ag, Pb, Zn, Al, Sn, Ru, Rh and Pd.

13. The process according to claim 10, wherein the step of forming the oxide coating includes adjusting the electroforming bath composition to enable formation of a oxide coating and maintaining the bath under such conditions that oxide coating forms.

14. The process according to claim 13, wherein the step of forming an oxide coating on the outer surface of the belt comprises the step of exposing the belt to air.

15. The process of claim 14, wherein a portion of the belt remains in he electroforming bath.

16. An endless metal belt assembly formed by a process comprising:
submerging a mandrel in an electroforming bath;
electroforming a first belt on said mandrel;
forming a coating comprised of an oxide of the electroformed metal on the outer surface of said first belt;
electroforming at least one additional belt on said first belt.

17. The belt assembly according to claim 16, wherein at least three electroformed belts are formed, and
wherein an oxide coating is formed between each successive belt.

18. The belt assembly according to claim 16, wherein the electroformed belt is comprised of a metal selected form the group consisting of Ni, Fe, Co, Au, Ag, Pb, Zn, Al, Sn, Ru, Rh and Pd.

19. The belt assembly according to claim 16, wherein the electroformed belts have a thickness of from 0.006 mm. to 0.6 mm.

20. The belt assembly of claim 16, wherein he oxide coating has a thickness of from 5 Å to 1500 Å.

21. The belt assembly according to claim 16, wherein said oxide coating is comprised of an oxide of the electroformed metal of the previously electroformed belt.

22. The belt assembly according tó claim 16, wherein said belt assembly is a driving member for a continuously-variable transmission.

23. An endless metal belt assembly comprised of two or more electroformed belts of metal superimposed on one another with a coating comprised of an oxide of the electroformed metal between each pair of successive belts.

* * * * *